United States Patent [19]

Bernardi

[11] 4,047,341

[45] Sept. 13, 1977

[54] FRAME STRUCTURE

[76] Inventor: James T. Bernardi, 17200 Fairfield, Detroit, Mich. 48221

[21] Appl. No.: 737,256

[22] Filed: Oct. 29, 1976

[51] Int. Cl.[2] ..... E04B 1/18; F16B 9/02; E04C 3/10

[52] U.S. Cl. ..... 52/223 R; 52/640; 52/648; 403/230; 403/409

[58] Field of Search ..... 52/640, 223, 648, 723, 52/86; 403/230, 188, 189, 409

[56] References Cited

U.S. PATENT DOCUMENTS

| | | | |
|---|---|---|---|
| 3,593,477 | 7/1971 | Briggs | 52/723 |
| 3,716,957 | 2/1973 | Bernardi | 52/729 |
| 3,971,179 | 7/1976 | Bodocsi | 52/640 |

*Primary Examiner*—John E. Murtagh
*Attorney, Agent, or Firm*—Cullen, Settle, Sloman & Cantor

[57] ABSTRACT

The frame structure comprises a pair of spaced apart vertical steel columns with a generally horizontally extending steel beam interposed between but spaced slightly from the columns by spacers carried by the columns. The columns and beam each has a generally H-shape cross-section. Moment inducing wedges are interposed in the spaces between the end faces of the beam and the columns. A plurality of fastening elements are provided at each end of the beam for initially rotating the beam on the spacers and for thereafter fixedly securing the beam to the columns, with the wedges when the fastening means are stressed inducing an upward camber into the beam prior to the application of the dead load. With such a construction the inclined face on each of the wedges is at an acute angle with respect to the vertical. By varying the acute angle or the angle in inclination of the inclined face on the wedge, variable end moments can be induced into the beam. The beam will carry its maximum dead load when the end moments (−) and mid span moment (+) of the beam are numerically equal to ($w1^2/16$) but in opposite directions.

9 Claims, 4 Drawing Figures

FRAME STRUCTURE

BACKGROUND OF THE PRESENT INVENTION

1. Field of the Invention

The frame structure of the present invention may be used in the construction industry where structural steel columns and beams are employed to form the framing system for large or multi-story buildings of various types.

2. Description of the Prior Art

In a normal beam construction with a uniform load, the beam or horizontal member rests on two supports at the ends of the beam. In such a case the maximum moment occurs at the center of the beam. When such beam is uniformly loaded, the mid span moment equals ($wl^2/8$) and the end moments are zero. In a simple beam, the beam deflects and an angle of rotation "X" develops at each end of the beam.

In a fixed beam construction where the ends thereof are rigidly fixed, the beam is restrained from rotating and thus the angle of rotation "X" at the end of the beam equals zero. In a fixed beam provided with a uniform load, the end moments equals $(-)(wl^2/12)$ and the midspan moment equals ($wl^2/24$). Thus it can be easily determined that the load of the fixed end beam is 1.5 times that of the simple beam.

It is further well known that a beam will carry its maximum load when the end moments and the midspan moment are numerically equal or where the moment at the center and at the ends equals ($wl^2/16$) but are applied in opposite directions to balance the moments.

The design formulations heretofore set forth are referred to in the following textbooks: Manual of Steel Construction, Seventh Edition, American Institute of Steel Construction; Steel Structures, by Prentiss-Hall, Inc. (Author, William McGuire) and Elements of Strength of Materials, Timoshenko-MacCullough, Second Edition, Publisher, D. Van Nostrand Co. Such textbooks as well as many others indicate the bending moment, vertical sheer and deflection of beams of uniform cross section under various conditions of loading.

SUMMARY OF THE PRESENT INVENTION

The present invention relates to a column-beam or frame construction, with the beam designed to carry its maximum load when the end moments and midspan moment are numerically equal to ($wl^2/16$) but in opposite directions. This can be achieved by recognizing that when a beam is subjected to a dead load, the ends of the beam deflects or rotates at an anxle "X". Thus, with the present invention an upward camber is induced into the beam at the time the beam is secured to the columns and prior to the application of dead load. With the induction of the upward camber into the beam, the ends of the beam rotate at an angle "X". Variable end moments can be induced into the beam by varying the angular rotation of the ends of the beam. The space between the columns and the ends of the beam are occupied by moment inducing wedges, each of which starting at the bottom thereof is provided with an upwardly and outwardly extending inclined surface which abuts the opposing surface on the beam. Such inclined surfaces of the wedges are at an angle "X" with respect to a vertical plane. Each wedge or wedge means is effective when the fastening means provided between the beam and the columns are effectively stressed to induce an upwardly extending camber in the beam whereby the end moments of the beam and the moment at the center of the beam is equal to ($wl^2/16$), where "$w$" is the uniform load per unit of length of the beam and "l" is the length of the beam. Spacers are secured to the columns for initially rotating the ends of the beam during the initial stressing of the fastening means.

It is therefore a feature of the present invention to provide a frame structure comprising a pair of spaced apart vertical columns having generally vertically extending mounting members, with the mounting member of one of the columns facing the mounting member on the other column, with spacing means being secured to each of the mounting members, a generally horizontal beam extending between the mounting members of the columns, and vertically extending end plates secured to the column faces of the beam, with the end plates facing the mounting members and being spaced therefrom by the spacing means.

With such a construction, a pair of moment inducing wedge means are interposed in the spaces between the corresponding mounting members and the end plates and thereafter fastening means are provided at each end of the beam for initially rotating the beam on the spacing means and for thereafter fixedly securing the end plates to the mounting members. Each of the wedge means starting at the bottom thereof is provided with an upwardly and outwardly extending inclined surface at an angle "X" with respect to a vertical plane. The inclined surfaces of the wedges abut the opposing end plates of the beam. Each wedge means is effective when the fastening means are effectively stressed to induce as a result of the beam rotating on the spacing means an upwardly extending camber in the beam prior to the application of dead loads to the structure.

A further feature of the present invention is to provide a structure of the aforementioned type wherein the wedge means are in the form of wedges which are provided with slots through which the fastening means extend.

A still further feature of the present invention is to provide a structure of the aforementioned type wherein the wedge means are in the form of wedges which are solid elements and wherein the wedges extend between adjacent vertical rows of fastening means.

Another feature of the present invention is to provide a structure of the aforementioned type wherein each wedge means is made from a single element or from a pair of elements which may be provided with or without slots for the fastening elements.

Still another feature of the present invention is to provide a structure of the aforementioned type wherein the columns and beam are made from structural steel elements, each having a generally H-shaped cross-section.

A further feature of the present invention is to provide a frame structure of the aforementioned type wherein the fastening means comprises threaded bolts and nuts arranged in rows both vertically and horizontally to connect the end plates of the beam to the columns by extending through or along the sides of the wedges.

A still further feature of the present invention is to provide a frame structure of the aforementioned type wherein the midspan moment and the end moments are equal to ($wl^2/16$) but applied in opposite directions.

A still further feature of the present invention is to provide a frame structure of the aforementioned type wherein the inclined surface of each wedge or wedge means has an angle "X" which can be varied to vary the end moments and center moment induced into the beam.

DESCRIPTION OF THE PREFERRED EMBODIMENT

Figure 1:
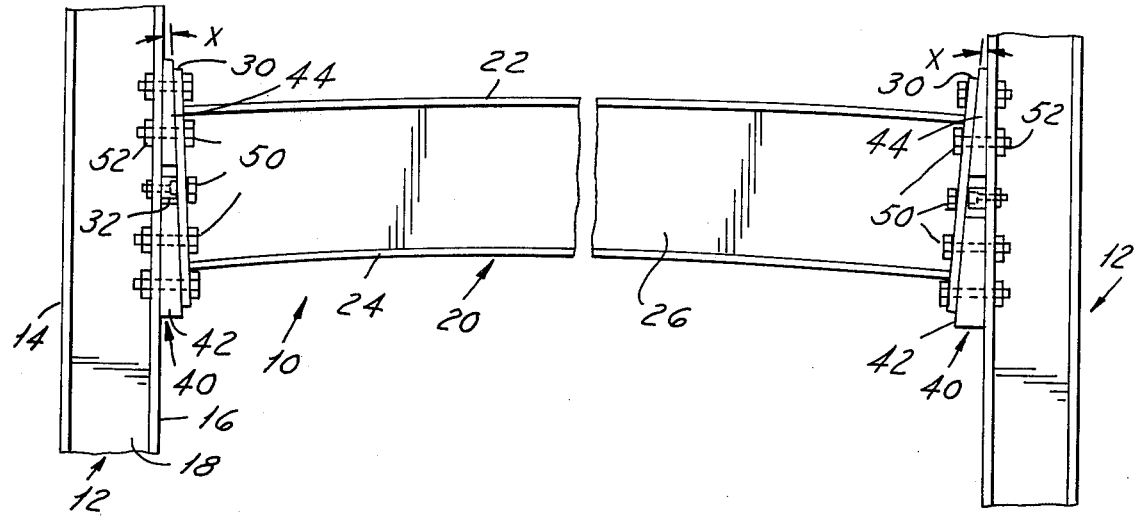
FIG. 1 is a fragmentary elevational view of a frame structure incorporating the wedges of the present invention for inducing an upward camber in the beam.

The semi-rigid frame structure is designated by the numeral 10 and comprises a pair of vertically extending columns 12, each column 12 having an H-shape cross section and including a pair of generally parallel flanges 14 and 16 connected by a vertically extending web 18 arranged perpendicular thereto. A structural steel beam 20 of generally H-shape cross section includes a pair of horizontally extending upper and lower flanges 22 and 24 respectively which are connected by a generally vertically extending web 26 arranged perpendicular to the flanges. The flanges 22 and 24 and the web 26 are of the same length. An end or butt plate 30 is welded to each end face of the beam 20 and has a length greater than the height of the beam and a width equal to the width of the beam. The beams and columns may take the form of channels, I-beams, H-section, or wide flange beams which are presently used in frame constructions and are commercially available.

Figure 2:
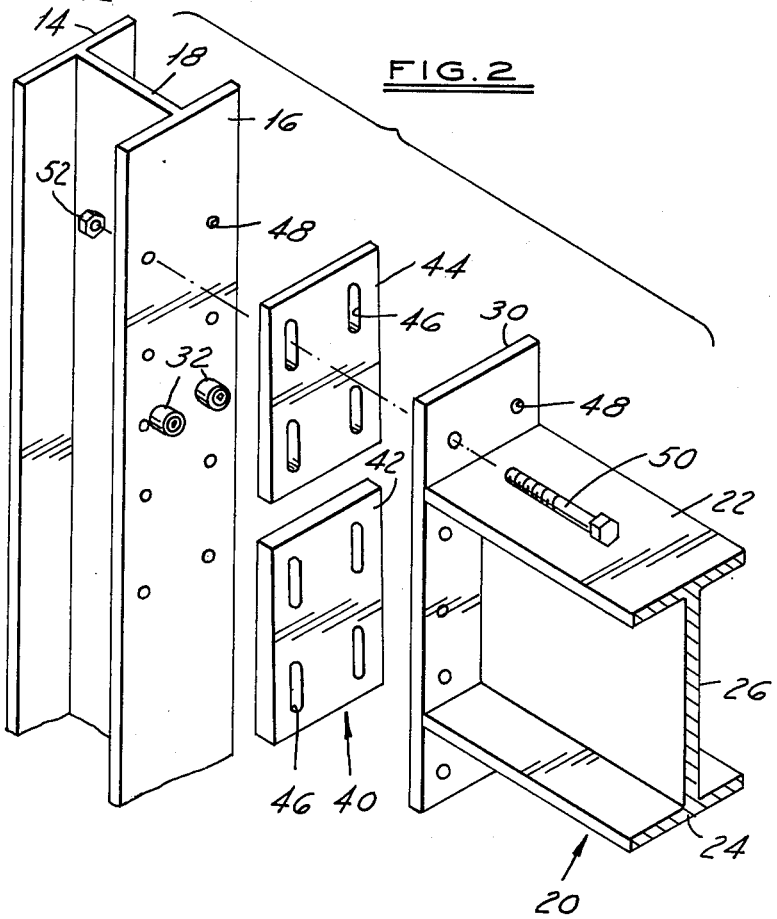
FIG. 2 is an exploded view of one end of the beam showing the manner in which the beam, wedges and column are connected by fastening elements.
Figure 3:
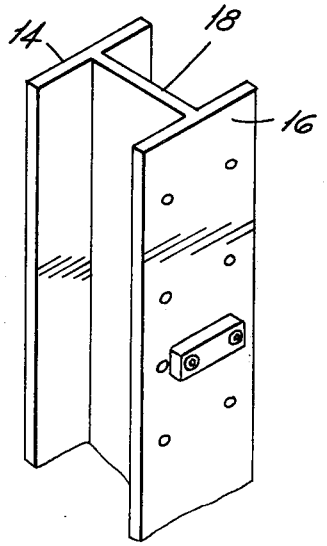
FIG. 3 is a fragmentary, perspective view of one of the columns with a modified form of a spacer secured to the mounting flange or member.

As illustrated in FIGS. 1–3 inclusive, the column flange 16 serves as the beam mounting member and is provided with a plurality of spacer bars or elements 32 which are laterally spaced apart and are welded or are appropriately secured to the flange 16. The spacers 32 may be in the form of washers or the like and provide or define fulcrums upon which the ends of the beam rotate as will subsequently appear.

Figure 4:
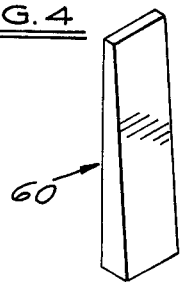
FIG. 4 is a modification of the wedge means constituting a single solid element having a vertical face and an inclined face at an snhlr "X" with respect to the vertical.

Wedge means 40 is provided at each end of the beam 20. The wedge means 40 may be made in one piece (like in FIG. 4) or in two pieces 42 and 44 as illustrated in FIGS. 1 and 2. In addition, the wedge means 40 may be provided with fastener slots 46 or may be solid as shown in FIG. 4. If slots 46 are provided they are arranged in rows which are horizontally and vertically spaced apart and have the same patterns as the end plates 30 and corresponding mounting flanges 16.

The butt or end plates 30 and the corresponding mounting flanges 16 are formed with rows of bolt openings 48 which are pre-arranged both vertically and horizontally. The rows of bolt openings 48 provided in plates 30 and flanges 16 are aligned with the rows of slots 46 provided in the wedge means 40.

Once the beam 20 is installed between the columns 12, with the wedge means 40 interposed between the corresponding end plates 30 and mounting flanges or members 16, bolts 50, one of each hole 48, are inserted through the openings 48 and slots 46 and thereafter the nuts 52 are secured thereto. The bolts 50 and nuts 52 form fastening means and such elements are initially torqued or stressed so as to rotate the ends of the beam on the spacers 32 through an angle "X" equal to the angle on the wedge means and to thereafter fixedly secure the end plates 30 of the beam 20 to the opposing mounting members 16 of the columns 12 thereby resulting in the beam having an upwardly extending camber as shown in FIG. 1.

When the wedge means 40 are provided with slots 46, it will, of course, be necessary to alternately tighten the bolts 50 and nuts 52 until the end plates 30 of the beam 20 are rigidly connected to the mounting flanges or members 16 of the columns 12.

When a solid wedge 60 of the type illustrated in FIG. 4 is utilized, such wedge is inserted between the fastening elements 50 after the beam 20 has been preliminarily connected to the columns 12. Initially, the bolts 50 in the upper part of the end plate 30 are inserted and tightened and thereafter the bolts in the lower part of the end plate 30 are inserted and tightened. Thereafter the wedge means 60 is inserted and driven upwards between the rows of bolts 50. As the wedge means 60 is driven, the upper bolts are tightened and the lower bolts are loose so as to allow the lower half of the beam 20 to move away from the column flanges 16. At the same time bolts 50 in the upper part are tightened. This procedure is done at both ends of the beam. It can be shown that the shims or wedge means 40 or 60 and bolts 50 cause the angle "X" to develop and the beam 20 is cambered upwardly as shown in FIG. 1. The beam 20 and end rotation can be so chosen that the end moments are ($wl^2/16$). When the dead loads are applied to the beam 20 the moments are balanced. The midspan moments becomes + ($wl^2/16$) and the end moments are equal to ($wl^2/16$).

It is also within the scope of the present invention that the beam 20 may be connected to the column webs 18 of columns 12, with the webs 18 forming the beam mounting members of the columns. With such a construction the bolts 50 on the upper part of the end plate 30 of the beam 20 and the bolts 50 on the lower part of the end plate 30 are secured on opposite sides of the web. The moments are balanced by the bolts 50 transferring the forces from the end plate 30 of the beam at one side of the web 18 to another reinforcing plate, not shown, provided on the other side of the web 18.

It should be noted that when the wedge illustrated in FIG. 4 is utilized, that it may be driven into the space between the beam and column either from the bottom upwardly or sideways.

The uniqueness of the present invention is in the use of the spacers, moment inducing wedges and bolts to effect end rotation of the beam through an angle "X" and to pre-induce a negative moment and upward camber into the beam 20 thus increasing the load carrying capability of the beam. With such a construction the angle of inclination of the wedge is equal to the angle of rotation of the ends of the beam. By changing such angle, variable end moments can be induced into the beam.

It should be appreciated that the number of rows of bolts used both vertically and horizontally may vary. Thus, as an example, there may be four bolts across the flange horizontally and up to seven rows of bolts arranged on the flange vertically.

I claim:

1. A frame structure comprising a pair of spaced apart vertical columns having vertically extending mounting members, the mounting member on one of said columns facing the mounting member on the other of said columns, spacing means forming a fulcrum secured to each of said mounting members at a place thereon spaced from the ends thereof, a horizontal beam extending between the mounting members of said columns, vertically extending end plates fixedly secured to the end portions of said beam, said end plates fixedly secured to the end portions of said beam, said end plates facing said mounting members and being spaced therefrom by and being engageable with said spacing means, moment inducing wedge means interposed in each of the spaces between the corresponding mounting members and end plates, rows of aligned openings in each of said mounting members and end plates which are horizontally and vertically spaced, and fastening means in the form of threaded bolts extending through said aligned openings in said mounting members and end plates and secured thereto by nuts, said fastening means at each end of the beam prior to the tightening of the nuts initially rotating the beam on said spacing means and thereafter after the tightening of the nuts fixedly securing the corresponding end plate of the beam to the opposing mounting member through said wedge means, each of said wedge means being arranged vertically and having an upwardly and outwardly inclined flat surface extending toward the corresponding mounting member and engageable with the opposing end plate of the beam, each wedge means having a vertically extending flat surface engageable with the opposing mounting member of the column, with said inclined flat surface and said vertical flat surface lying in planes which intersect at an acute angle, each wedge means being effective when the threaded bolts and nuts are stressed to induce as a result of the beam rotating on said spacing means an upwardly extending camber in the beam prior to the application of dead loads to the structure, said wedge means being held in the spaces between the corresponding members and end plates solely by the forces generated by said fastening means, without any physical attachment to said fastening means.

2. The frame structure defined in claim 1 wherein each wedge means is provided with slots through which said fastening means extend.

3. The frame structure defined in claim 1 wherein each wedge means comprises a pair of wedges which are located at opposite sides of said spacing means.

4. The frame structure defined in claim 3 wherein said wedges are solid.

5. The frame structure defined in claim 3 wherein each of the wedges is solid and is located between said vertical rows of openings containing said threaded bolts.

6. The frame structure defined in claim 3 wherein each of the wedges is provided with slots through which said threaded bolts extend.

7. The frame structure defined in claim 1 wherein each wedge means is in the form of a single solid element, with said threaded bolts extending along the sides of the wedges.

8. The frame structure defined in claim 1 wherein said spacing means on each of said columns is in the form of a pair of laterally spaced cylindrical elements which are fixedly secured to the mounting member and against which the beam rotates during the assembly of the beam to the columns.

9. The frame structure defined in claim 1 wherein said spacing means on each of said columns is in the form of an elongated laterally extending element which is fixedly secured to the mounting member and against which the beam rotates during the assembly of the beam to the columns.

* * * * *